US010749286B2

(12) United States Patent
Wang et al.

(10) Patent No.: US 10,749,286 B2
(45) Date of Patent: Aug. 18, 2020

(54) ELECTRICAL CONNECTOR WITH AN ELECTRICAL TERMINAL FEATURING MATERIAL REDUCTION AND MATERIAL INCREASE PORTIONS

(71) Applicant: CHENG UEI PRECISION INDUSTRY CO., LTD., New Taipei (TW)

(72) Inventors: Han-Wei Wang, New Taipei (TW); Sheng-Yuan Huang, New Taipei (TW); Pei-Yi Lin, New Taipei (TW); Te-Hung Yin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/252,642

(22) Filed: Jan. 20, 2019

(65) Prior Publication Data

US 2019/0319388 A1 Oct. 17, 2019

(30) Foreign Application Priority Data

Apr. 16, 2018 (CN) ..... 2018 2 0536207 U

(51) Int. Cl.
*H01R 12/72* (2011.01)
*H01R 13/41* (2006.01)
(Continued)

(52) U.S. Cl.
CPC ..... *H01R 13/41* (2013.01); *H01R 9/0515* (2013.01); *H01R 12/00* (2013.01); *H01R 12/57* (2013.01); *H01R 12/62* (2013.01); *H01R 12/707* (2013.01); *H01R 12/7011* (2013.01); *H01R 12/714* (2013.01); *H01R 12/716* (2013.01); *H01R 12/72* (2013.01); *H01R 12/721* (2013.01); *H01R 12/73* (2013.01); *H01R 12/78* (2013.01); *H01R 12/79* (2013.01)

(58) Field of Classification Search
CPC .. H01R 12/721; H01R 12/714; H01R 12/716; H01R 12/79; H01R 12/57; H01R 12/72; H01R 12/73; H01R 12/00; H01R 12/62; H01R 12/707; H01R 12/78; H01R 12/7011; H01R 9/0515
USPC ..... 439/747, 62, 64, 629, 493
See application file for complete search history.

(56) References Cited

U.S. PATENT DOCUMENTS

2003/0224632 A1* 12/2003 Regnier ..... H01R 13/41 439/79
2013/0012038 A1* 1/2013 Kirk ..... H01R 12/721 439/55

* cited by examiner

*Primary Examiner* — Abdullah A Riyami
*Assistant Examiner* — Justin M Kratt
(74) *Attorney, Agent, or Firm* — Cheng-Ju Chiang

(57) ABSTRACT

An electrical connector includes an insulating housing and a plurality of electrical terminals. A top wall of the insertion space defines a plurality of terminal grooves recessing upward. The plurality of electrical terminals are arranged in the plurality of the terminal grooves. Each of the plurality of the electrical terminals has a fixing portion. A middle of the fixing portion is of a hollow shape and is defined as a material reduction area. A front end of the fixing portion is connected with a contacting portion. A bottom of the fixing portion extends downward to form a guiding portion. A rear of the guiding portion is bent sideward and then is bent frontward to form a material increase area. two sides of the guiding portion are chamfered to form two chamfers. A bottom end of the guiding portion extends rearward to from a soldering portion.

15 Claims, 10 Drawing Sheets

(51) Int. Cl.

| | |
|---|---|
| *H01R 12/00* | (2006.01) |
| *H01R 12/71* | (2011.01) |
| *H01R 12/70* | (2011.01) |
| *H01R 12/73* | (2011.01) |
| *H01R 12/78* | (2011.01) |
| *H01R 12/62* | (2011.01) |
| *H01R 12/57* | (2011.01) |
| *H01R 12/79* | (2011.01) |
| *H01R 9/05* | (2006.01) |

ELECTRICAL CONNECTOR WITH AN ELECTRICAL TERMINAL FEATURING MATERIAL REDUCTION AND MATERIAL INCREASE PORTIONS

BACKGROUND OF THE INVENTION

1. Field of the Invention

The present invention generally relates to an electrical connector and an electrical terminal thereof, and more particularly to an electrical connector and an electrical terminal thereof with better electrical characteristics.

2. The Related Art

With the increasing demands for networks and communication, requirements of the industry for cloud computing and storage are growing at a high speed. A data center is on a trend of continuous developments, so transmission speed requirements of data communication and data storage applied to devices continue being raised. From past 2.5 Gbps or 5 Gbps per channel to current 10 Gbps or even 28 Gbps. Requirements of connectors on an integrity of signal transmissions continue being increased. Generally, a connector includes an insulation body, a circuit board mounted in the insulation body, and a plurality of terminals surrounded by the insulation body. Analyze from the circuit board to the plurality of the terminals enclosed by the insulation body, parameters of convergence adjustment for impedance consistencies, insertion losses, return losses, signal delays and so on are several obvious indexes that affect performances of the connector.

With reference to FIG. 10, a conventional electrical connector 100' includes an insulating housing 10' and a plurality of conductive terminals. The plurality of the conductive terminals include a plurality of electrical terminals 20' and a plurality of contact components 30'. The insulating housing 10' is an integrally molded component. A middle of a front surface of the insulating housing 10' is recessed rearward to form an insertion space 11', several portions of an inner surface of a top wall of the insertion space 11' are recessed upward to form a plurality of terminal grooves 13' extending to a rear end of the insulating housing 10'. Several portions of a rear surface of the insulating housing 10' are recessed frontward and penetrate through a bottom surface of the insulating housing 10' to form a plurality of guiding grooves 14'. A top of each guiding groove 14' is communicated and connected with a rear end of one of the plurality of the terminal grooves 13'. A front of each guiding groove 14' is recessed frontward to form a fixing groove 15'.

The plurality of the electrical terminals 20' are disposed in the plurality of the terminal grooves 13' and transversely arranged. Each of the plurality of the electrical terminals 20' has a fixing portion 21', a front end of a top of the fixing portion 21' is connected with a contact portion 22', and a guiding portion 23' extended downward from a bottom of the fixing portion 21'. A middle of the guiding portion 23' has a lying U-shaped reflexed portion 231'. A bottom end of the guiding portion 23' is bent rearward to form a soldering portion 24'. The fixing portions 21' of the plurality of the electrical terminals 20' are assembled in the plurality of the electrical terminal grooves 13'. The contact portions 22' of the plurality of the electrical terminals 20' are exposed downward to the insertion space 11'. The guiding portions 23' of the plurality of the electrical terminals 20' are assembled in the plurality of the guiding grooves 14'. The reflexed portion 231' of each electrical terminal 20' is assembled in the fixing groove 15'. The soldering portions 24' of the plurality of the electrical terminals 20' project out of the rear end of the insulating housing 10'.

With reference to FIG. 6 to FIG. 10, a simulation waveform graph of output impedances of the plurality of the electrical terminals 20' of the conventional electrical connector 100' is shown in FIG. 6. A simulation waveform graph of input impedances of the plurality of the electrical terminals 20' of the conventional electrical connector 100' is shown in FIG. 7. A simulation waveform graph of insertion losses of the plurality of the electrical terminals 20' of the conventional electrical connector 100' is shown in FIG. 8. A simulation waveform graph of return losses of the plurality of the electrical terminals 20' of the conventional electrical connector 100' is shown in FIG. 9. It can be seen that a simulation curve P1 and a simulation curve P2 of the impedances of the plurality of the electrical terminals 20' will exceed a scope specified by a small form-factor pluggable (SFP) connector in the simulation waveform graphs in prior art. A difference value between a maximum value of the output impedance of the simulation curve P1 and a minimum value of the output impedance of the simulation curve P1 exceeds 10Ω. A difference value between a maximum value of the input impedance of the simulation curve P2 and a minimum value of the input impedance of the simulation curve P2 exceeds 10Ω. As a result, the conventional electrical connector 100' is unable to have a stable high frequency effect.

Therefore, it is necessary to provide an innovative electrical connector and an electrical terminal of the innovative electrical connector, so that impedances of the electrical terminal conform to a scope specified by the SFP electrical connector, and insertion losses and return losses of the innovative electrical connector are optimized for reaching stabler and more effective electrical characteristics.

SUMMARY OF THE INVENTION

An object of the present invention is to provide an electrical connector. The electrical connector includes an insulating housing and a plurality of electrical terminals. A middle of a front surface of the insulating housing is recessed rearward to form an insertion space. A top wall of the insertion space defines a plurality of terminal grooves recessed upward. A rear surface of the insulating housing defines a plurality of guiding grooves recessing frontward and penetrating through a bottom surface of the insulating housing. A top of each guiding groove is communicated with a rear end of one of the plurality of the terminal grooves. A portion of an inner surface of one side wall of each guiding groove is recessed sideward to form a notch. The plurality of electrical terminals are transversely arranged in the plurality of the terminal grooves. Each of the plurality of the electrical terminals has a fixing portion. A middle of the fixing portion is of a hollow shape and is defined as a material reduction area. An upper portion of a front end of the fixing portion is connected with a contacting portion. A bottom of the fixing portion extends downward to form a guiding portion. A rear of the guiding portion is bent sideward and then is bent frontward to form a material increase area. Fronts of two sides of the guiding portion are chamfered to form two chamfers slantwise extending to a front surface of the guiding portion. A bottom end of the guiding portion extends rearward to from a soldering portion. The fixing portions of the plurality of the electrical terminals are mounted in the plurality of the terminal grooves. The contacting portions of the plurality of the electrical terminals project downward to the insertion space. The guiding portions of the plurality of the electrical terminals are mounted in the plurality of the guiding grooves. The material increase area of each electrical terminal is mounted in the notch. The soldering portions of the plurality of the electrical terminals project out of a rear end of the insulating housing.

Another object of the present invention is to provide an electrical terminal fastened in an electrical connector. The electrical terminal has a fixing portion, a contacting portion connected with an upper portion of a front end of the fixing portion, a guiding portion extended downward from a bottom of the fixing portion, and a soldering portion extended rearward from a bottom end of the guiding portion. A middle of the fixing portion is of a hollow shape, and is defined as a material reduction area. Fronts of two sides of the guiding portion are chamfered to form two chamfers slantwise extending to a front surface of the guiding portion.

Another object of the present invention is to provide an electrical terminal fastened in an electrical connector. The electrical terminal includes a fixing portion, a contacting portion connected with an upper portion of a front end of the fixing portion, a guiding portion extended downward from a bottom of the fixing portion, and a soldering portion extended rearward from a bottom end of the guiding portion. A middle of the fixing portion is of a hollow shape, and is defined as a material reduction area. A rear of the guiding portion is bent sideward and then is bent frontward to form a material increase area. Fronts of two sides of the guiding portion are chamfered to form two chamfers slantwise extending to a front surface of the guiding portion.

As described above, the electrical connector provides the material reduction area opened in the fixing portion of each electrical terminal, and the material increase area and the two chamfers increased in the guiding portion of each electrical terminal, so that impedances of each electrical terminal conform to the scope specified by SFP electrical connector, and the insertion losses and the return losses of the electrical connector are optimized for passing through a high-frequency request to have a stabler high-frequency effect and reaching stabler and more effective electrical characteristics.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
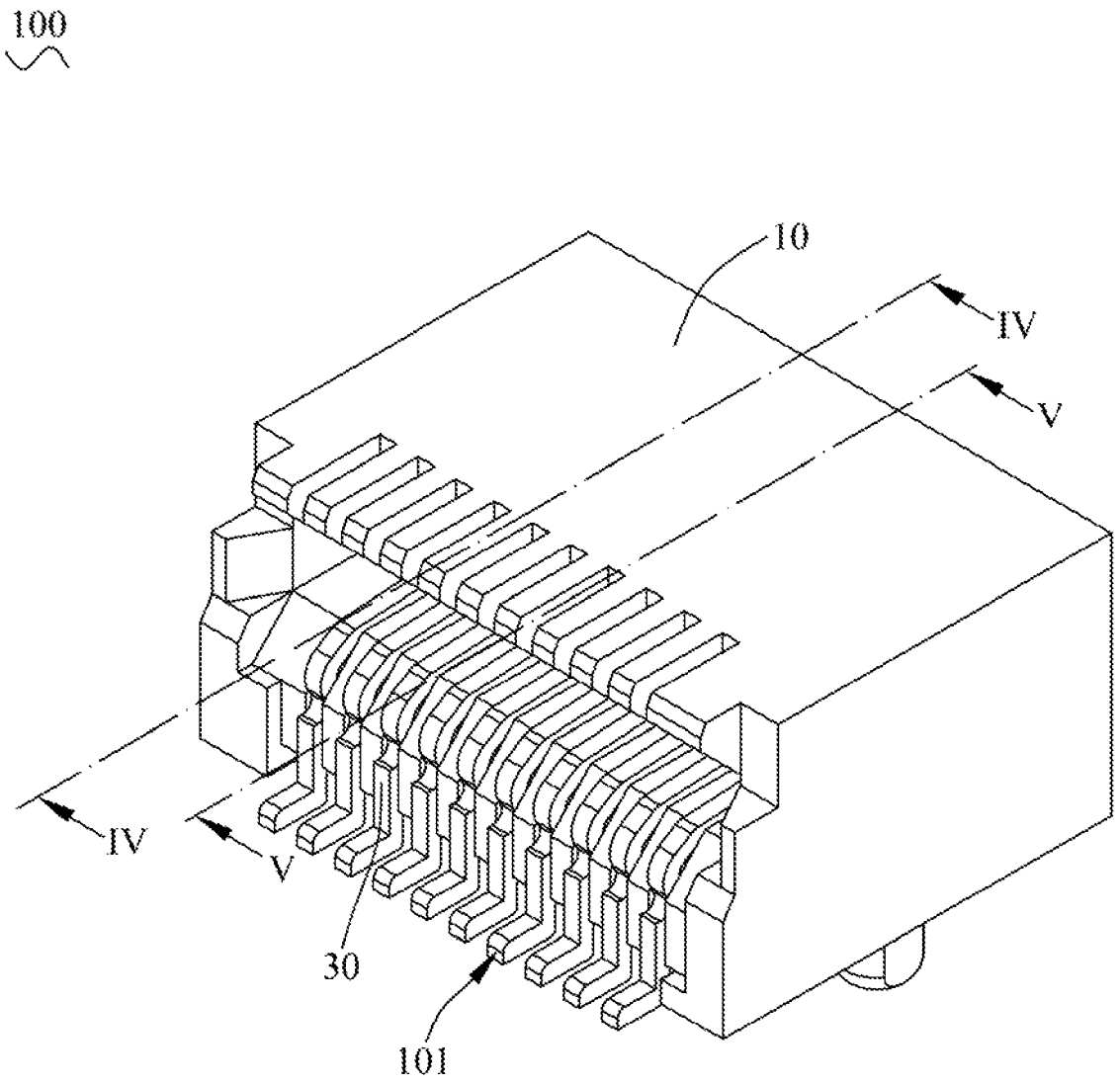
FIG. 1 is a perspective view of an electrical connector in accordance with a preferred embodiment of the present invention.
Figure 2:
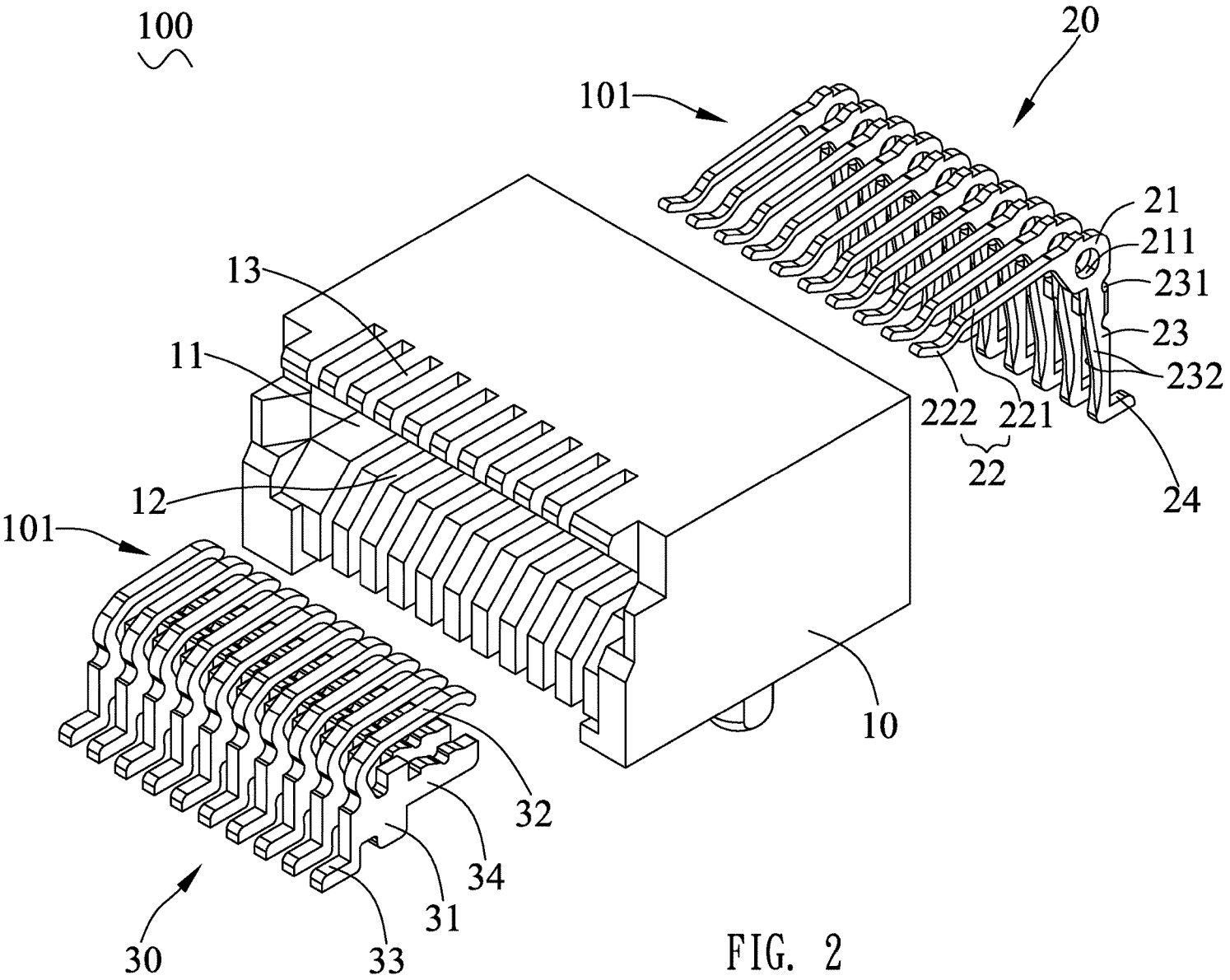
FIG. 2 is an exploded perspective view of the electrical connector of FIG. 1.

With reference to FIG. 1 and FIG. 2, an electrical connector 100 in accordance with the present invention is shown. The electrical connector 100 is a small form-factor pluggable (SFP) electrical connector. The electrical connector 100 includes an insulating housing 10, and a plurality of conductive components 101. The plurality of the conductive components 101 include a plurality of electrical terminals 20 and a plurality of contact components 30.

With reference to FIG. 1 to FIG. 4, the insulating housing 10 is an integrally molded component. A middle of a front surface of the insulating housing 10 is recessed rearward to form an insertion space 11. A top wall of the insertion space 11 defines a plurality of terminal grooves 13 recessing upward, and the plurality of the terminal grooves 13 are arranged transversely and extend to a rear end of the insulating housing 10. A bottom wall of the insertion space 11 defines a plurality of locating grooves 12 recessing downward for locating the plurality of the contact components 30. The plurality of the locating grooves 12 penetrate through a bottom surface and the front surface of the insulating housing 10, and the plurality of the locating grooves 12 are arranged transversely. Each of the plurality of the locating grooves 12 includes a receiving slot 123 extending longitudinally and penetrating through the front surface of the insulating housing 10, a fixing slot 121 extended downward from a front of a bottom of the receiving slot 123, and penetrating through the front surface and the bottom surface of the insulating housing 10, and a buckling slot 122 extended rearward from a middle of a rear of the fixing slot 121. A rear surface of the insulating housing 10 defines a plurality of guiding grooves 14 recessing frontward and penetrating through the bottom surface of the insulating housing 10. A top of each guiding groove 14 is communicated with a rear end of one of the plurality of the terminal grooves 13. A portion of an inner surface of one side wall of each guiding groove 14 is recessed sideward to form a notch 141.

Figure 3:
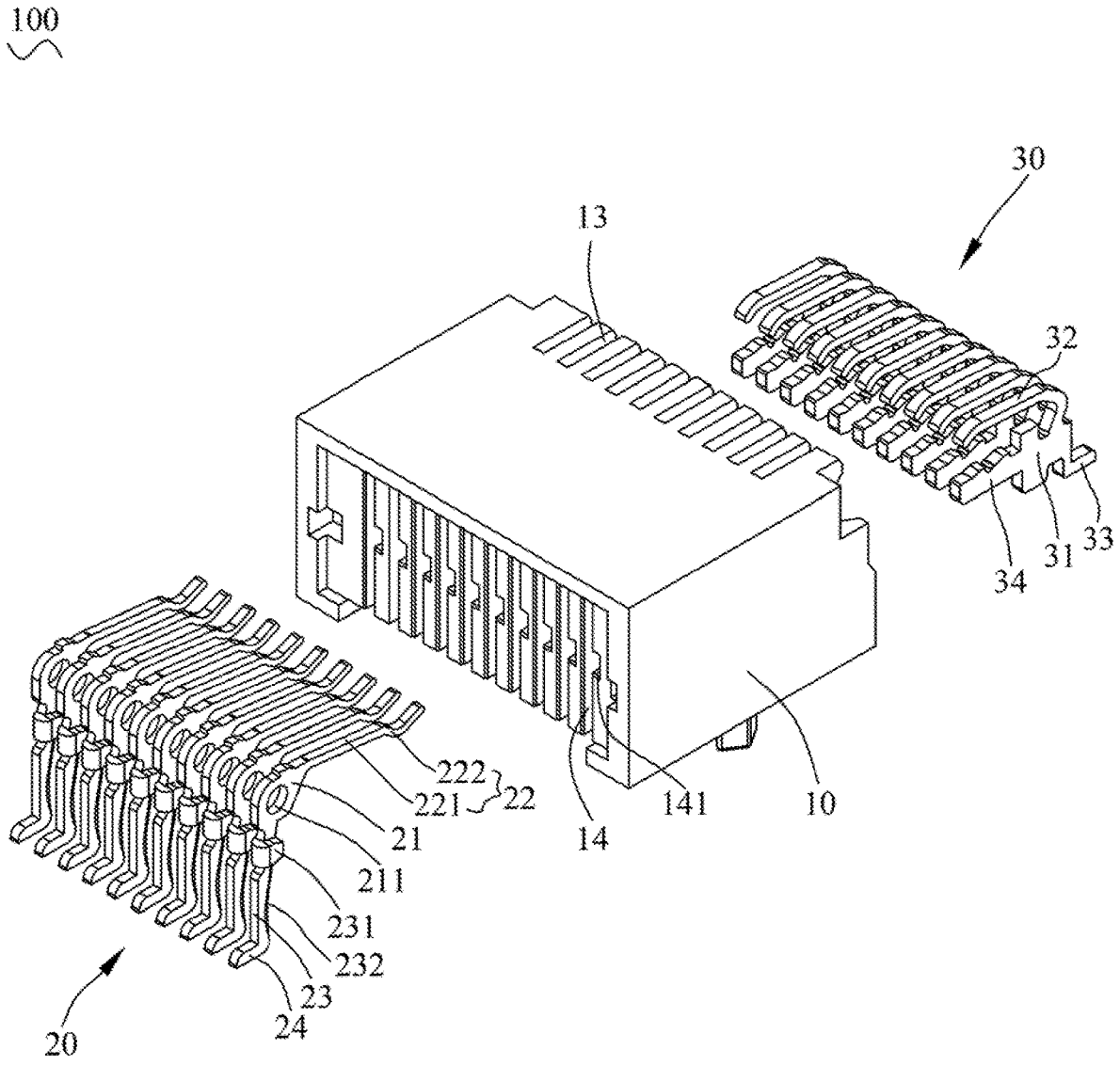
FIG. 3 is another exploded perspective view of the electrical connector of FIG. 2.
Figure 5:
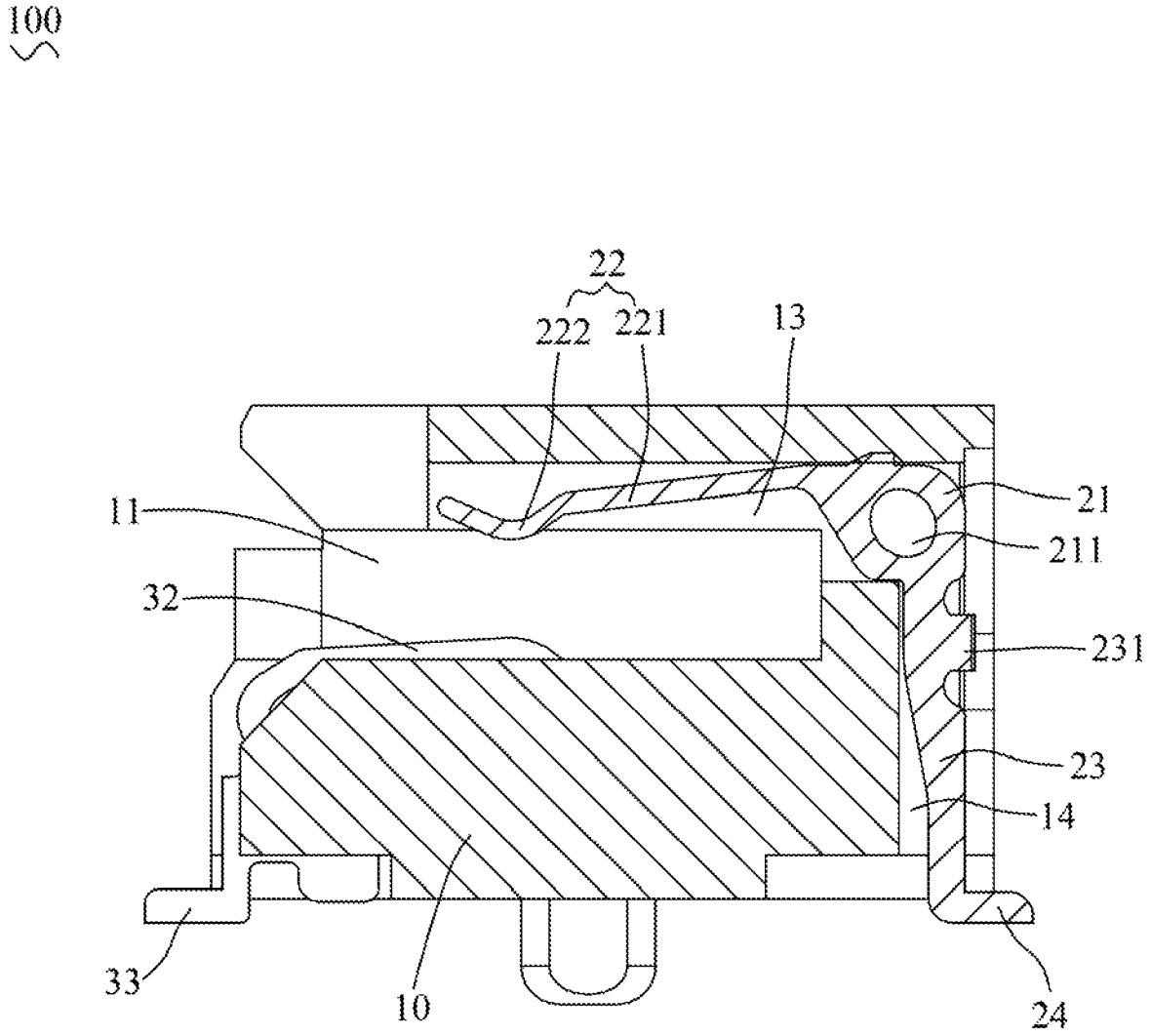
FIG. 5 is a cross-section view of the electrical connector along a line V-V of FIG. 1.
Figure 6:
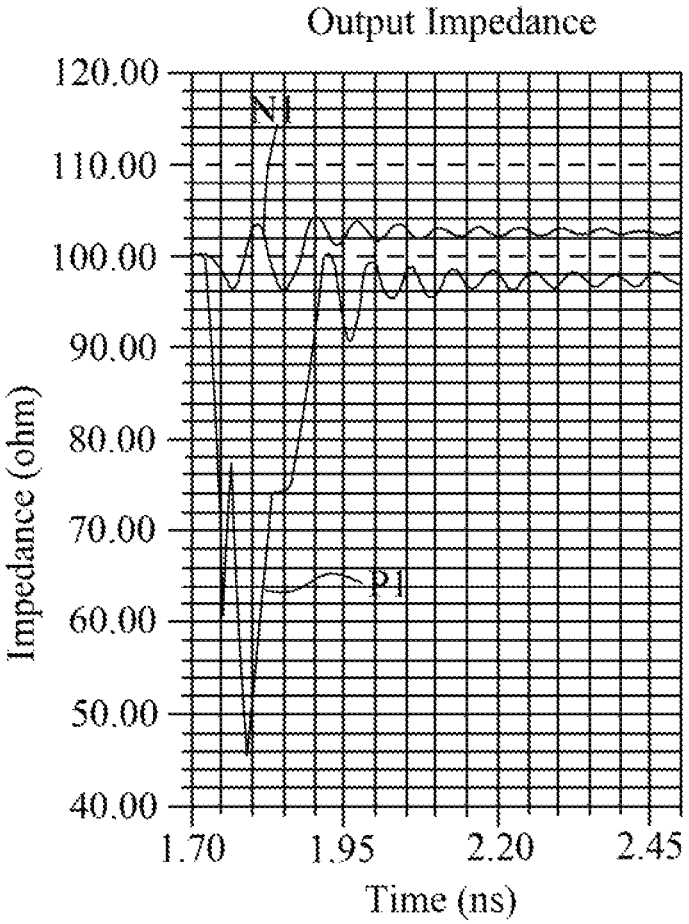
FIG. 6 shows simulation waveform graphs of impedances of a conventional electrical connector in prior art and the electrical connector of FIG. 1, wherein a simulation curve P1 of output impedances of the conventional electrical connector in the prior art is compared with a simulation curve N1 of output impedances of the electrical connector of FIG. 1.
Figure 7:
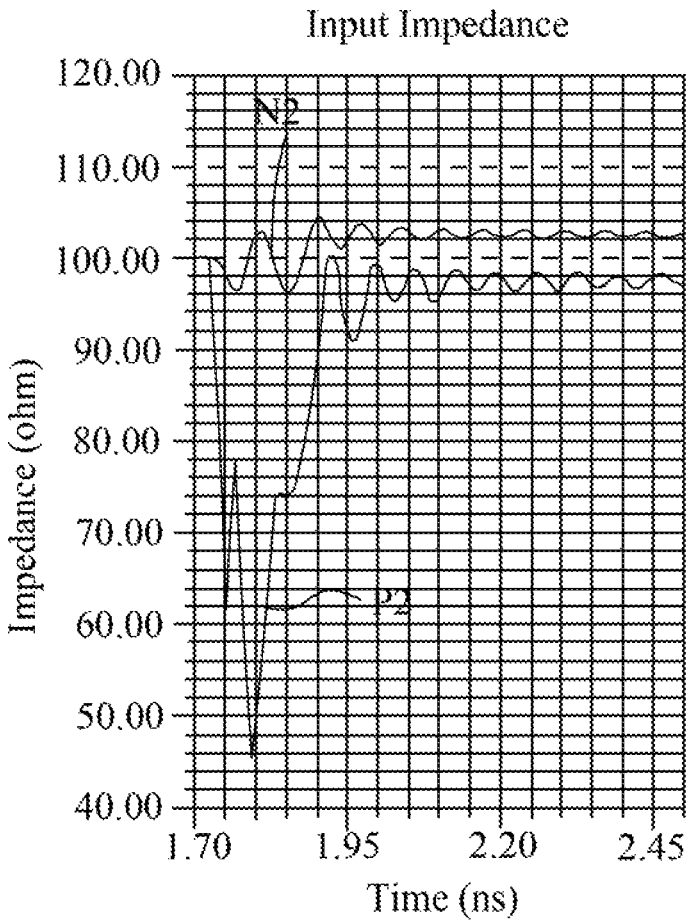
FIG. 7 shows another simulation waveform graph of the impedances of the conventional electrical connector in prior art and the electrical connector of FIG. 1, wherein a simulation curve P2 of input impedances of the conventional electrical connector in the prior art is compared with a simulation curve N2 of input impedances of the electrical connector of FIG. 1.

With reference to FIG. 2, FIG. 3 and FIG. 5, each of the plurality of the electrical terminals 20 fastened in the electrical connector 100, has a fixing portion 21, a contacting portion 22 connected with an upper portion of a front end of the fixing portion 21, a guiding portion 23 extended downward from a bottom of the fixing portion 21, and a soldering portion 24 extended rearward from a bottom end of the guiding portion 23. A middle of the fixing portion 21 is of a hollow shape, and is defined as a material reduction area 211. In this preferred embodiment, the material reduction area 211 is a substantially circle opening and is opened in the middle of the fixing portion 21. The upper portion of the front end of the fixing portion 21 is connected with the contacting portion 22. The contacting portion 22 has an elastic arm 221 extended frontward and downward from the upper portion of the front end of the fixing portion 21, and a V-shaped contact arm 222 connected with a free end of the elastic arm 221 and seen from a side view of the contact arm 222. The bottom of the fixing portion 21 extends downward to form the guiding portion 23. A rear of the guiding portion 23 is bent sideward and then is bent frontward to form a material increase area 231.

With reference to FIG. 2, FIG. 3, FIG. 5 and FIG. 10, in this preferred embodiment, an inner side surface of the material increase area 231 is corresponding to and faces one side surface of the guiding portion 23. A shape of the inner side surface of the material increase area 231 is fit with a shape of the one side surface of the guiding portion 23. The inner side surface of the material increase area 231 is attached to the one side surface of the guiding portion 23. The material increase area 231 is corresponding to the notch 141. Fronts of two sides of the guiding portion 23 are chamfered to form two chamfers 232 slantwise extending to a front surface of the guiding portion 23. Compare the guiding portion 23' of prior art with the guiding portion 23, each chamfer 232 has a material reduction feature. The bottom end of the guiding portion 23 extends rearward to from the soldering portion 24. The plurality of the electrical terminals 20 are transversely arranged in the plurality of the terminal grooves 13. Specifically, the fixing portions 21 of the plurality of the electrical terminals 20 are mounted in the plurality of the terminal grooves 13 respectively. The elastic arms 221 and the contact arms 222 of the contacting portions 22 of the plurality of the electrical terminals 20 project downward to the insertion space 11. The guiding portions 23 of the plurality of the electrical terminals 20 are mounted in the plurality of the guiding grooves 14. The material increase area 231 of each electrical terminal 20 is mounted in the notch 141. The soldering portions 24 of the plurality of the electrical terminals 20 project out of the rear end of the insulating housing 10.

Figure 4:
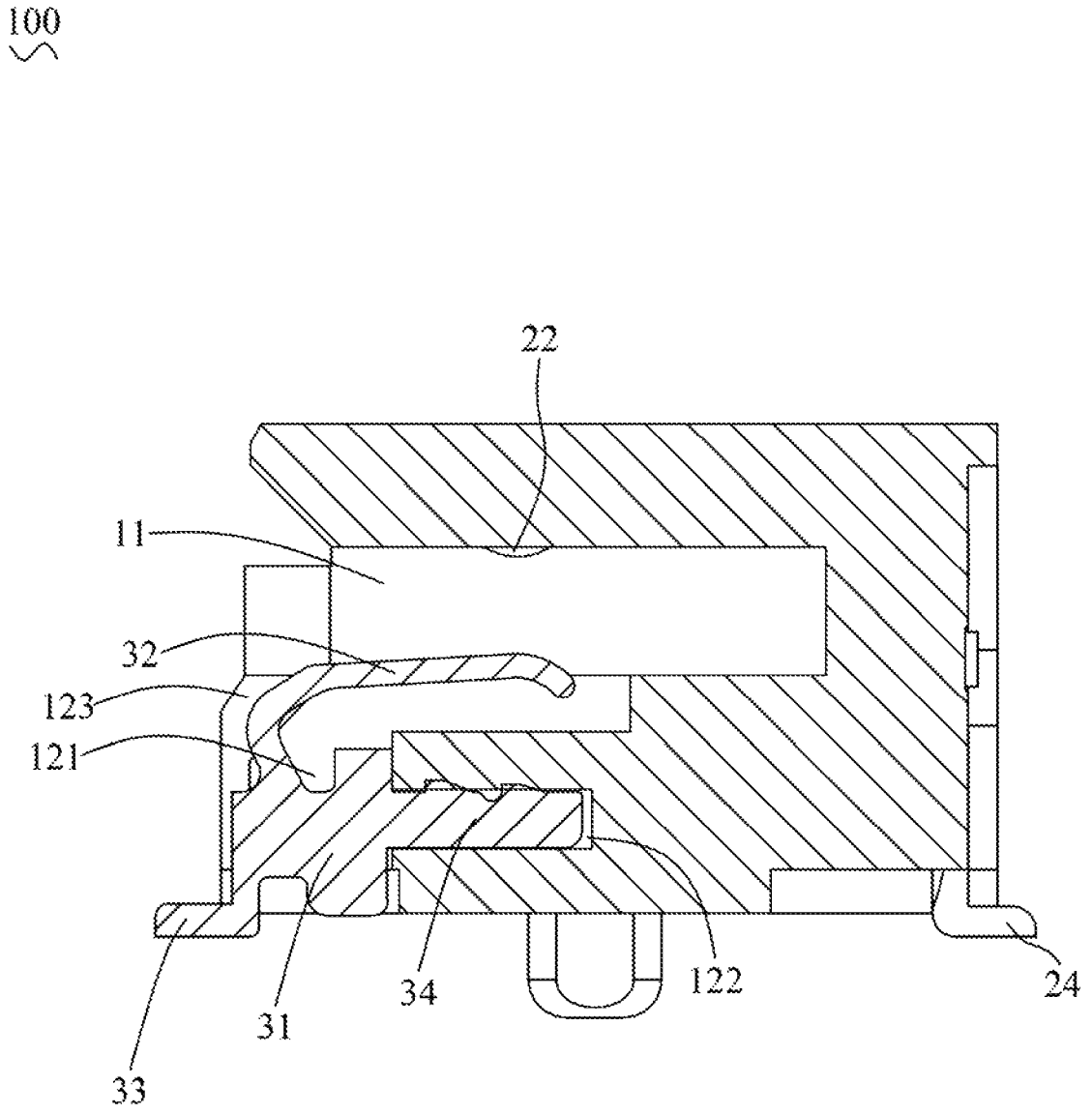
FIG. 4 is a cross-section view of the electrical connector along a line IV-IV of FIG. 1.

With reference to FIG. 2 to FIG. 4, the plurality of the contact components 30 are transversely arranged in the plurality of the locating grooves 12 and project into the insertion space 11. Each of the plurality of the contact components 30 has a fastening portion 31. A top portion of the fastening portion 31 extends upward and then is bent rearward to form a touching portion 32. A tail end of the touching portion 32 extends rearward and then is bent downward. A bottom of the fastening portion 31 extends downward and then extends frontward to form a soldering foot 33. A rear end of the fastening portion 31 protrudes rearward to form a buckling portion 34. The fastening portion 31 of each contact component 30 is fixed in the fixing slot 121 of one of the plurality of the locating grooves 12. The buckling portion 34 of each contact component 30 is buckled in the buckling slot 122 of the one of the plurality of the locating grooves 12. The touching portion 32 of each contact component 30 is disposed in the receiving slot 123 of the one of the plurality of the locating grooves 12 and projects upward into the insertion space 11. The soldering foot 33 of each contact component 30 projects beyond the front surface of the insulating housing 10.

Figure 8:
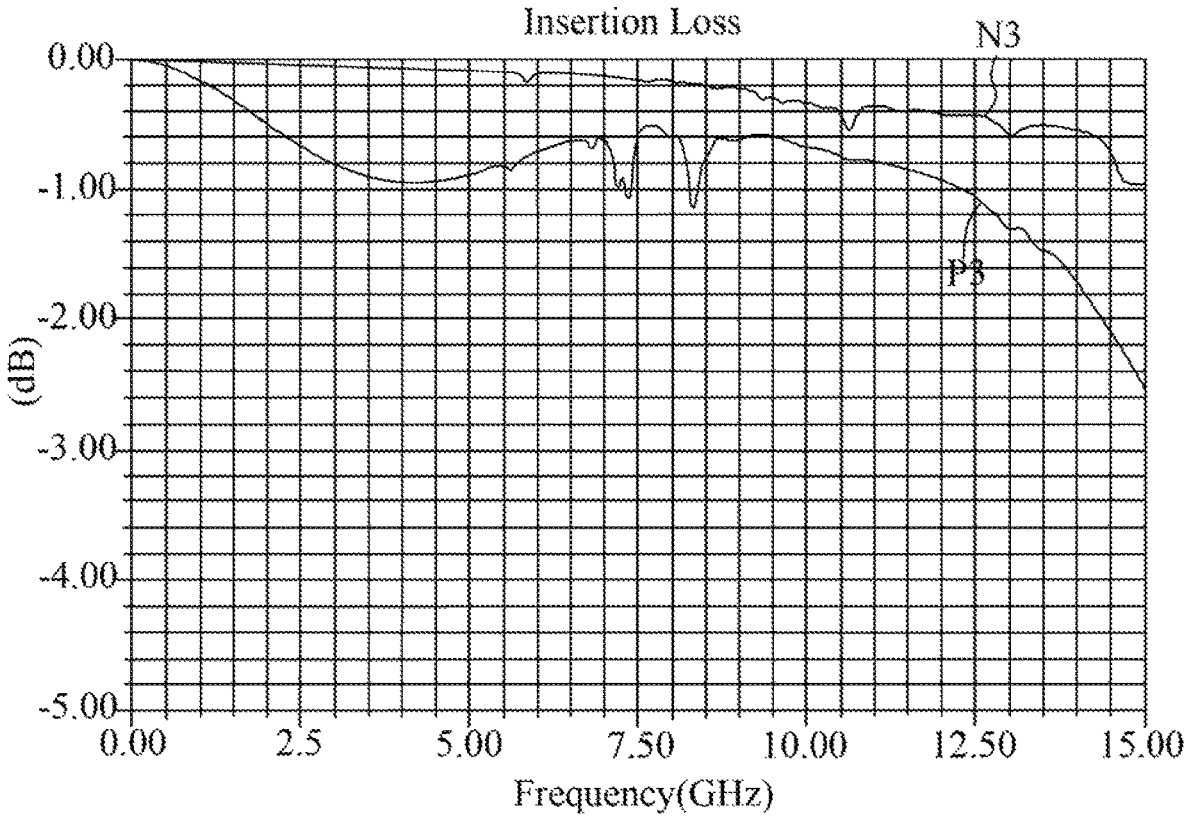
FIG. 8 shows simulation waveform graphs of insertion losses of the conventional electrical connector in the prior art and the electrical connector of FIG. 1, wherein a curve P3 of the insertion losses of the conventional electrical connector in the prior art is compared with a curve N3 of the insertion losses of the electrical connector of FIG. 1.
Figure 9:
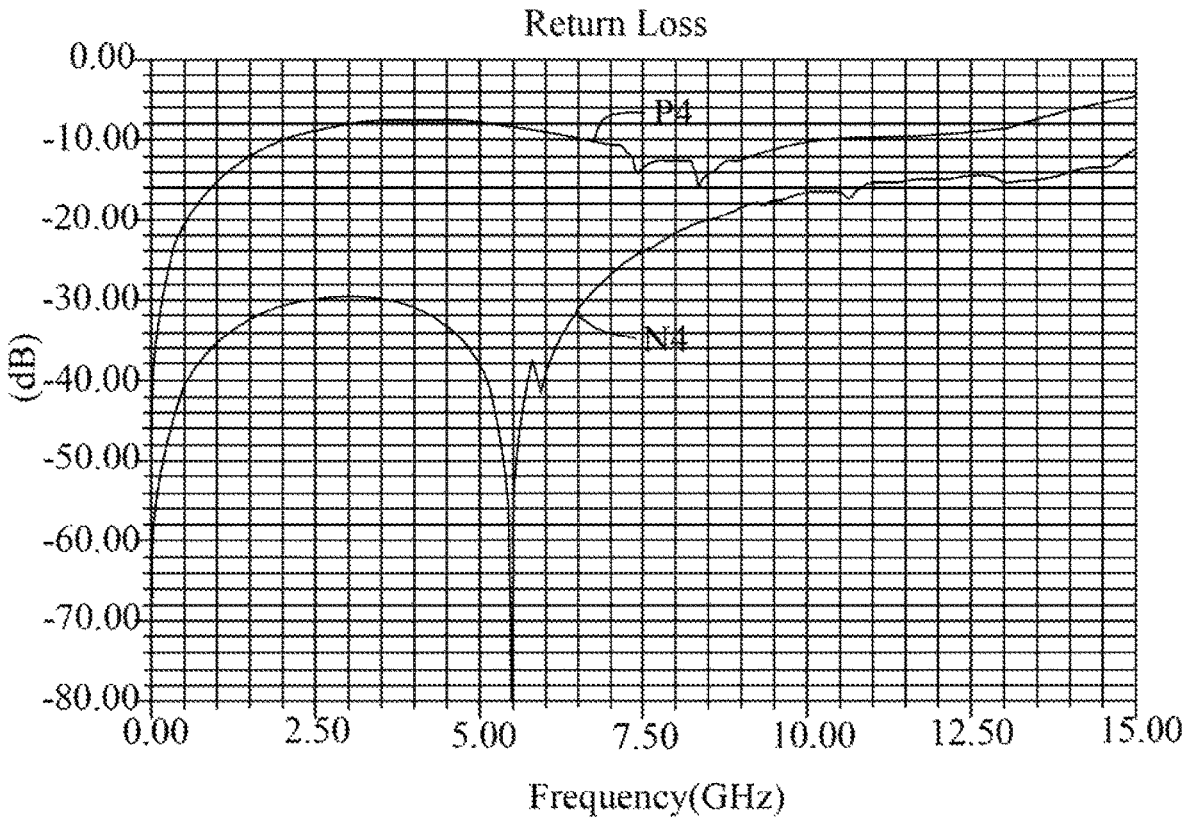
FIG. 9 shows simulation waveform graphs of return losses of the conventional electrical connector in the prior art and the electrical connector of FIG. 1, wherein a curve P4 of the return losses of the conventional electrical connector in the prior art is compared with a curve N4 of the return losses of the electrical connector of FIG. 1.
Figure 10:
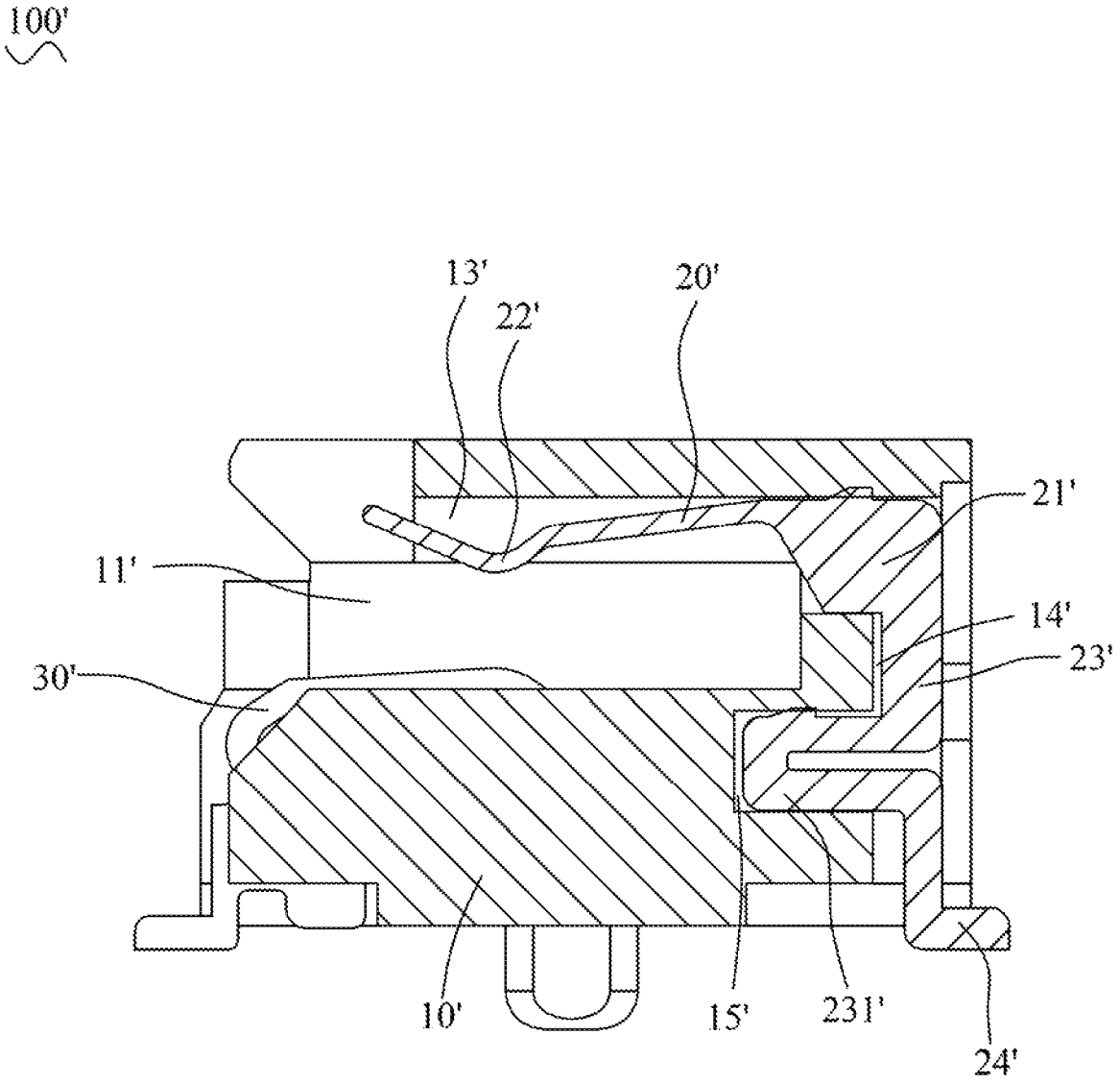
FIG. 10 (Prior Art)
FIG. 10 is a cross-section view of the conventional electrical connector in the prior art.

With reference to FIG. 1 to FIG. 10, FIG. 6 and FIG. 7 show simulation waveform graphs of impedances of a conventional electrical connector 100' in prior art and the electrical connector 100, a simulation curve P1 of output impedances of the conventional electrical connector 100' is compared with a simulation curve N1 of output impedances of the electrical connector 100, and a simulation curve P2 of input impedances of the conventional electrical connector 100' is compared with a simulation curve N2 of input impedances of the electrical connector 100. FIG. 8 shows simulation waveform graphs of insertion losses of the conventional electrical connector 100' and the electrical connector 100, a curve P3 of the insertion losses of the conventional electrical connector 100' is compared with a curve N3 of the insertion losses of the electrical connector 100. FIG. 9 shows simulation waveform graphs of return losses of the conventional electrical connector 100' and the electrical connector 100, a curve P4 of the return losses of the conventional electrical connector 100' is compared with a curve N4 of the return losses of the electrical connector 100.

Comparing with the prior art, a difference value between a maximum value of the output impedance and a minimum value of the output impedance of each electrical terminal 20 of the electrical connector 100 is within 10Ω and conforms to a scope specified by the SFP electrical connector. A difference value between a maximum value of the input impedance and a minimum value of the input impedance of each electrical terminal 20 of the electrical connector 100 is within 10Ω and conforms to the scope specified by the SFP electrical connector. In addition, the insertion losses of the electrical connector 100 are lower than the insertion losses of the conventional electrical connector 100' in the prior art, and the return losses of the electrical connector 100 are less than the return losses of the conventional electrical connector 100' in the prior art. Namely, when a transmitter and a receiver are transmitted between each other, a weakening extent of electrical signals is smaller than a weakening extent of electrical signals in the prior art, and an extent of reflected electrical signals generated at the time of signals arriving at the transmitter or the receiver is smaller than an extent of reflected electrical signals generated at the time of signals arriving at a transmitter or a receiver of the prior art, so that interferences suffered by the electrical signals in a transmission process are lowered to make the electrical signals have a better transmission capacity.

As described above, the electrical connector 100 provides a material reduction area 211 opened in the fixing portion 21 of each electrical terminal 20, and the material increase area 231 and the two chamfers 232 increased in the guiding portion 23 of each electrical terminal 20, so that the impedances of each electrical terminal 20 conform to the scope specified by the SFP electrical connector, and the insertion losses and the return losses of the electrical connector 100 are optimized for passing through a high-frequency request to have a stabler high-frequency effect and reaching stabler and more effective electrical characteristics.

What is claimed is:

1. An electrical connector, comprising:

an insulating housing, a middle of a front surface of the insulating housing being recessed rearward to form an insertion space, a top wall of the insertion space defining a plurality of terminal grooves recessing upward, a rear surface of the insulating housing defining a plurality of guiding grooves recessing frontward and penetrating through a bottom surface of the insulating housing, a top of each guiding groove being communicated with a rear end of one of the plurality of the terminal grooves, a portion of an inner surface of one side wall of each guiding groove being recessed sideward to form a notch; and a plurality of electrical terminals transversely arranged in the plurality of the terminal grooves, each of the plurality of the electrical terminals having a fixing portion, a middle of the fixing portion being of a hollow shape and being defined as a material reduction area, an upper portion of a front end of the fixing portion being connected with a contacting portion, a bottom of the fixing portion extending downward to form a guiding portion, a rear of the guiding portion being bent sideward and then being bent frontward to form a material increase area, fronts of two sides of the guiding portion being chamfered to form two chamfers slantwise extending to a front surface of the guiding portion, a bottom end of the guiding portion extending rearward to from a soldering portion, the fixing portions of the plurality of the electrical terminals being mounted in the plurality of the terminal grooves, the contacting portions of the plurality of the electrical terminals projecting downward to the insertion space, the guiding portions of the plurality of the electrical terminals being mounted in the plurality of the guiding grooves, the material increase area of each electrical terminal being mounted in the notch, the soldering portions of the plurality of the electrical terminals projecting out of a rear end of the insulating housing.

2. The electrical connector as claimed in claim 1, wherein a bottom wall of the insertion space defines a plurality of locating grooves recessing downward for locating a plurality of contact components, the plurality of the contact components are transversely arranged in the plurality of the locating grooves and project into the insertion space.

3. The electrical connector as claimed in claim 2, wherein each of the plurality of the locating grooves includes a receiving slot extending longitudinally and penetrating through the front surface of the insulating housing, and a fixing slot extended downward from a front of a bottom of the receiving slot, each of the plurality of the contact components has a fastening portion, a top portion of the fastening portion extends upward and then is bent rearward to form a touching portion, a tail end of the touching portion extends rearward and then is bent downward, a bottom of the fastening portion extends downward and then extends frontward to form a soldering foot, the fastening portion of each contact component is fixed in the fixing slot of one of the plurality of the locating grooves, the touching portion of each contact component is disposed in the receiving slot of the one of the plurality of the locating grooves and projects upward into the insertion space, the soldering foot of each contact component projects beyond the front surface of the insulating housing.

4. The electrical connector as claimed in claim 3, further comprising a buckling slot extended rearward from a middle of a rear of the fixing slot, a rear end of the fastening portion protruding rearward to form a buckling portion, the buckling portion of each contact component being buckled in the buckling slot of the one of the plurality of the locating grooves.

5. The electrical connector as claimed in claim 1, wherein an inner side surface of the material increase area is corresponding to and faces one side surface of the guiding portion, a shape of the inner side surface of the material increase area is fit with a shape of the one side surface of the guiding portion, the inner side surface of the material increase area is attached to the one side surface of the guiding portion, the material increase area is corresponding to the notch.

6. The electrical connector as claimed in claim 1, wherein the material reduction area is a substantially circular opening.

7. The electrical connector as claimed in claim 1, wherein the contacting portion of each electrical terminal has an elastic arm extended frontward and downward from the upper portion of the front end of the fixing portion, and a V-shaped contact arm connected with a free end of the elastic arm and seen from a side view of the contact arm, the elastic arms and the contact arms of the contacting portions of the plurality of the electrical terminals project downward to the insertion space.

8. An electrical terminal fastened in an electrical connector, comprising:

a fixing portion, a middle of the fixing portion being of a hollow shape, and being defined as a material reduction area;

a contacting portion connected with an upper portion of a front end of the fixing portion;

a guiding portion extended downward from a bottom of the fixing portion, fronts of two sides of the guiding portion being chamfered to form two chamfers slantwise extending to a front surface of the guiding portion, a rear of the guiding portion being bent sideward and then bent frontward to form a material increase area; and a soldering portion extended rearward from a bottom end of the guiding portion.

9. The electrical terminal as claimed in claim 8, wherein an inner side surface of the material increase area is corresponding to and faces one side surface of the guiding portion, a shape of the inner side surface of the material increase area is fit with a shape of the one side surface of the guiding portion, the inner side surface of the material increase area is attached to the one side surface of the guiding portion.

10. The electrical terminal as claimed in claim 8, wherein the material reduction area is a substantially circular opening.

11. The electrical terminal as claimed in claim 8, wherein the contacting portion has an elastic arm extended frontward and downward from the upper portion of the front end of the fixing portion, and a V-shaped contact arm connected with a free end of the elastic arm and seen from a side view of the contact arm.

12. An electrical terminal fastened in an electrical connector, comprising:

a fixing portion, a middle of the fixing portion being of a hollow shape, and being defined as a material reduction area;

a contacting portion connected with an upper portion of a front end of the fixing portion;

a guiding portion extended downward from a bottom of the fixing portion, a rear of the guiding portion being bent sideward and then being bent frontward to form a material increase area, fronts of two sides of the guiding portion being chamfered to form two chamfers slantwise extending to a front surface of the guiding portion; and a soldering portion extended rearward from a bottom end of the guiding portion.

13. The electrical terminal as claimed in claim 12, wherein an inner side surface of the material increase area is corresponding to and faces one side surface of the guiding portion, a shape of the inner side surface of the material increase area is fit with a shape of the one side surface of the guiding portion, the inner side surface of the material increase area is attached to the one side surface of the guiding portion.

14. The electrical terminal as claimed in claim 12, wherein the material reduction area is a substantially circular opening.

15. The electrical terminal as claimed in claim 12, wherein the contacting portion has an elastic arm extended frontward and downward from the upper portion of the front end of the fixing portion, and a V-shaped contact arm connected with a free end of the elastic arm and seen from a side view of the contact arm.

* * * * *